US008250873B2

(12) United States Patent
Yoon et al.

(10) Patent No.: US 8,250,873 B2
(45) Date of Patent: Aug. 28, 2012

(54) ANTI-CONDENSATION CONTROL SYSTEM

(75) Inventors: Doo Eui Yoon, San Jose, CA (US); Paul Artwohl, Flossmoor, IL (US)

(73) Assignee: Anthony, Inc., Sylmar, CA (US)

( * ) Notice: Subject to any disclaimer, the term of this patent is extended or adjusted under 35 U.S.C. 154(b) by 823 days.

(21) Appl. No.: 12/337,981

(22) Filed: Dec. 18, 2008

(65) Prior Publication Data

US 2010/0083672 A1 Apr. 8, 2010

Related U.S. Application Data

(60) Provisional application No. 61/102,721, filed on Oct. 3, 2008.

(51) Int. Cl.

| | |
|---|---|
| ***F25D 21/00*** | (2006.01) |
| ***F25D 21/02*** | (2006.01) |
| ***F25D 21/04*** | (2006.01) |
| ***F25D 21/08*** | (2006.01) |

(52) U.S. Cl. ..... 62/150; 62/128; 62/248; 62/176.1

(58) Field of Classification Search ..... 62/128, 62/150, 248, 176.1

See application file for complete search history.

(56) References Cited

U.S. PATENT DOCUMENTS

| | | | | |
|---|---|---|---|---|
| 3,443,395 | A | | 5/1969 | Schweiger et al. |
| 3,859,502 | A | | 1/1975 | Heaney |
| 3,868,492 | A | | 2/1975 | Taylor |
| 3,945,217 | A | | 3/1976 | Bashark |
| 4,048,469 | A | | 9/1977 | Ciarniello et al. |
| 4,127,765 | A | | 11/1978 | Heaney |
| 4,260,876 | A | | 4/1981 | Hochheiser |
| 4,590,546 | A | | 5/1986 | Maile |
| 4,615,179 | A | * | 10/1986 | Chiu et al. ..... 62/129 |
| 5,000,579 | A | * | 3/1991 | Kumada et al. ..... 374/28 |
| 5,027,077 | A | | 6/1991 | Yanagisawa et al. |
| 5,082,173 | A | | 1/1992 | Poehlman et al. |
| 5,144,811 | A | | 9/1992 | Brodie et al. |

(Continued)

FOREIGN PATENT DOCUMENTS

| | | |
|---|---|---|
| JP | 56-105514 | 8/1981 |

(Continued)

OTHER PUBLICATIONS

Energy Independence and Security Act of 2007 § 312, Dec. 13, 2007.

(Continued)

*Primary Examiner* — Cheryl J Tyler
*Assistant Examiner* — Jonathan Bradford
(74) *Attorney, Agent, or Firm* — Knobbe, Martens, Olson & Bear, LLP

(57) ABSTRACT

System and methods for providing anti-condensation system are disclosed. A relative humidity (RH) sensor signal from a sensor on or near a control surface is received. An AC power input is received. A phase of the AC power input is modulated at least partly in response to the sensor signal in such a manner that a phase-modulated AC power output provided to a heater is a) substantially constant at a first power level ($P_{1st}$) in a low RH region ranging from 0% RH to a first RH ($RH_1$), b) varying as a function of the sensor signal from $P_{1st}$ to a second power level ($P_{2nd}$) in an intermediate RH region ranging from $RH_1$ to a second RH ($RH_2$), and c) substantially constant at $P_{2nd}$ in a high RH region beginning at $RH_2$.

25 Claims, 5 Drawing Sheets

U.S. PATENT DOCUMENTS

| | | | |
|---|---|---|---|
| 5,216,226 | A | 6/1993 | Miyoshi |
| 5,261,251 | A | 11/1993 | Galiyano |
| 5,778,689 | A | 7/1998 | Beatenbough |
| 5,899,078 | A | 5/1999 | Mager |
| 6,144,017 | A | 11/2000 | Millett et al. |
| 6,467,282 | B1 | 10/2002 | French et al. |
| 6,470,696 | B1 | 10/2002 | Palfy et al. |
| 6,470,697 | B2 | 10/2002 | Nakamura et al. |
| 6,550,261 | B1 | 4/2003 | Shima et al. |
| 6,647,782 | B2 | 11/2003 | Toyoda |
| 6,653,606 | B1 | 11/2003 | Son et al. |
| 6,862,891 | B2 | 3/2005 | Devos |
| 6,866,391 | B2 | 3/2005 | Krausse |
| 7,137,262 | B2 | 11/2006 | Carter |
| 7,178,350 | B2 | 2/2007 | Shah |
| 7,207,181 | B2 | 4/2007 | Murray et al. |
| 7,240,501 | B2 | 7/2007 | Bunch et al. |
| 7,266,960 | B2 | 9/2007 | Shah |
| 7,301,640 | B2 | 11/2007 | Tice |
| 7,340,907 | B2 | 3/2008 | Vogh, III |
| 7,392,838 | B2 | 7/2008 | Errington et al. |
| 2005/0229614 | A1 | 10/2005 | Ansted |
| 2005/0268627 | A1 | 12/2005 | Vogh, III |
| 2006/0004494 | A1 | 1/2006 | Errington |
| 2006/0026975 | A1 | 2/2006 | Bunch et al. |
| 2007/0165322 | A1 | 7/2007 | Strom et al. |
| 2007/0182347 | A1 * | 8/2007 | Shteynberg et al. ..... 315/312 |
| 2007/0193294 | A1 | 8/2007 | Murray et al. |
| 2007/0193999 | A1 | 8/2007 | Peterson et al. |
| 2008/0115514 | A1 | 5/2008 | Steimel |

FOREIGN PATENT DOCUMENTS

| | | |
|---|---|---|
| WO | WO 03/039193 | 5/2003 |

OTHER PUBLICATIONS

International Search Report and Written Opinion issued to related international application PCT/US2009/059291 on Nov. 25, 2009.

* cited by examiner

ANTI-CONDENSATION CONTROL SYSTEM

CROSS-REFERENCE TO RELATED APPLICATIONS

This application claims priority from U.S. Provisional Patent Application No. 61/102,721, filed on Oct. 3, 2008, which is incorporated herein by reference.

BACKGROUND OF THE INVENTION

1. Field of the Invention

Systems and methods for preventing or reducing condensation, and more particularly, systems and methods for controlling anti-condensation heaters.

2. Description of the Related Technology

Refrigerated spaces such as refrigerated display cases, walk-in refrigerators, and walk-in freezers commonly include heaters to prevent condensation from forming on certain areas of the device from water vapor present as humidity in the surrounding air. For example, walk-in refrigerators and freezers typically employ a heater to prevent condensation from forming on air vents, personnel doors, drain lines, and observation windows. Similarly, refrigerated display cases such as coffin cases, island cases, and tub cases typically employ a heater to prevent condensation from forming on and around an opening and/or door of the display case. For example, glass-door refrigerated display cases are frequently used in supermarkets and convenience stores and often include heaters in the glass doors and the door frames to prevent condensation on the glass from humid air.

SUMMARY OF CERTAIN INVENTIVE ASPECTS

The following detailed description is directed to certain specific embodiments. However, the teachings herein can be applied in a multitude of different ways.

In certain aspects, there can be an anti-condensation control apparatus comprising a sensor circuit having a humidity sensor and configured to provide a sensor signal indicative of a relative humidity (RH) on or near a control surface. The anti-condensation control apparatus can also comprise a control circuit having a phase control circuit configured to receive the sensor signal and a high-voltage AC power input, and modulate a phase of the high-voltage AC power input at least partly in response to the sensor signal in such a manner that a phase-modulated AC power output provided to a heater is a) substantially constant at a minimum power level ($P_{min}$) in a low RH region ranging from 0% RH to a first RH ($RH_1$), b) linearly varying from $P_{min}$ to a maximum power level ($P_{max}$) in an intermediate RH region ranging from $RH_1$ to a second RH ($RH_2$), wherein the position of $RH_1$ and/or $RH_2$ is user-adjustable, and c) substantially constant at $P_{max}$ in a high RH region ranging from $RH_2$ to 100% RH. In some embodiments, the phase control circuit may not have a digital logic circuit.

In other aspects, there can be a method of preventing anti-condensation comprising receiving a relative humidity (RH) sensor signal from a sensor on or near a control surface. The method can further comprise receiving an AC power input. The method can further comprise modulating a phase of the AC power input at least partly in response to the sensor signal in such a manner that a phase-modulated AC power output provided to a heater is a) substantially constant at a first power level ($P_{1st}$) in a low RH region ranging from 0% RH to a first RH ($RH_1$), b) varying as a function of the sensor signal from $P_{1st}$ to a second power level ($P_{2nd}$) in an intermediate RH region ranging from $RH_1$ to a second RH ($RH_2$), and c) substantially constant at $P_{2nd}$ in a high RH region beginning at $RH_2$.

In other aspects, there can be an anti-condensation control apparatus comprising a sensor module configured to measure a relative humidity (RH) and/or a water condensation on or near a control surface and to provide a sensor signal indicative of the RH and/or the water condensation. The anti-condensation control apparatus can further comprise a control module configured to receive the sensor signal and an AC power input, and to provide a phase-modulated AC power output to a heater at least partly in response to the sensor signal. The control module can include an alternating current (AC) switch configured to receive a phase-control input that triggers the AC switch to deliver the phase-modulated AC power output to the heater during a specified phase of the AC power input. The control module can further include a first output control circuit configured to provide at least a portion of a first control voltage to the phase-control input to cause the AC switch to provide a first substantially constant phase-modulated AC power output to the heater in a low RH region. The control module can further include a second output control circuit configured to provide at least a portion of a second control voltage to the phase-control input to cause the AC switch to provide a substantially linearly varying phase-modulated AC power output to the heater in an intermediate RH region. The control module can further include a third output control circuit configured to provide at least a portion of a third control voltage to the phase-control input to cause the AC switch to provide a second substantially constant phase-modulated AC power output to the heater in a high RH region.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION OF CERTAIN PREFERRED EMBODIMENTS

Figure 1:
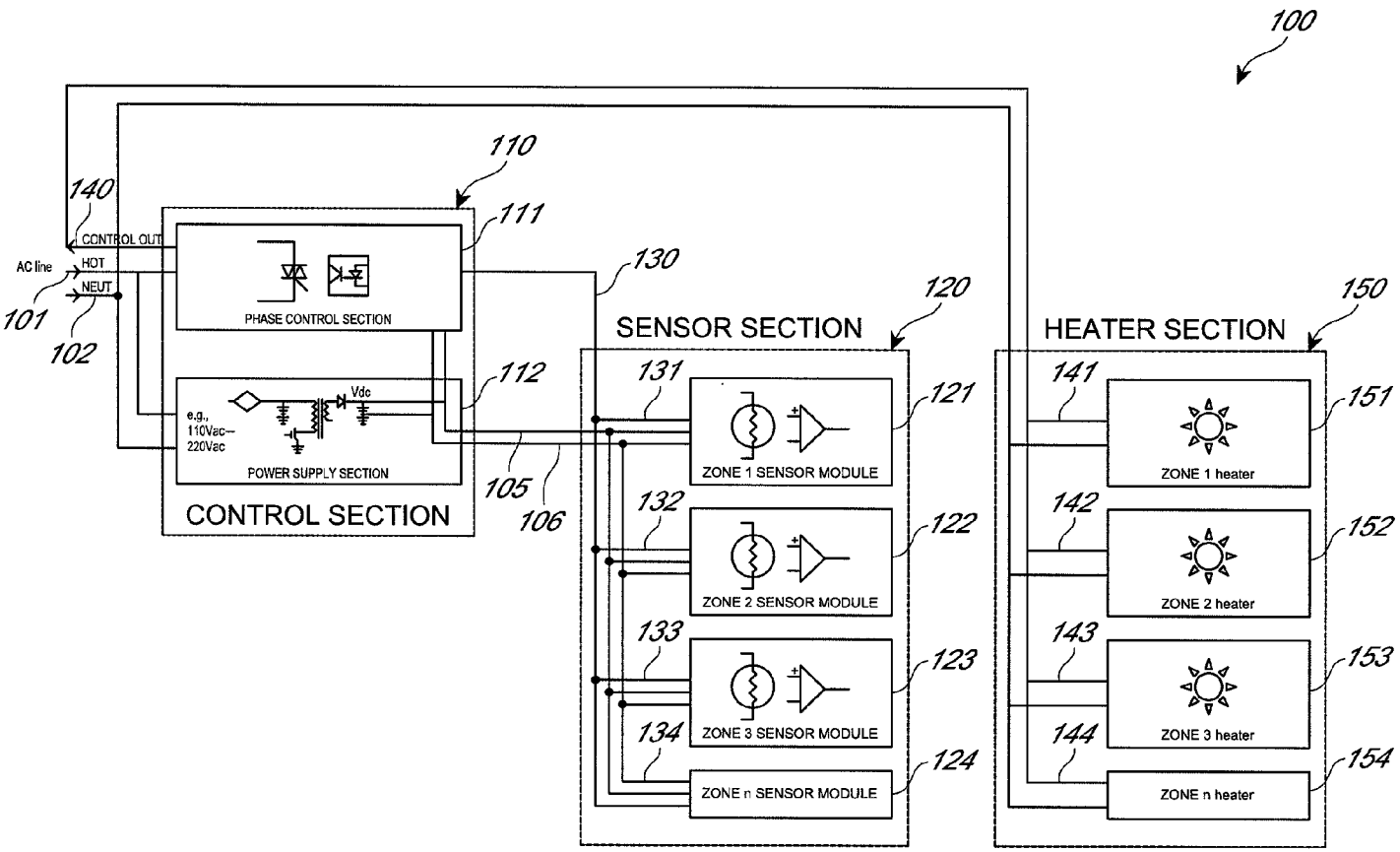
FIG. 1 shows a block diagram illustrating an example anti-condensation control system according to one embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and make part of this disclosure.

As discussed above, refrigerated spaces such as refrigerated display cases, walk-in refrigerators, and walk-in freezers commonly include heaters to prevent condensation from forming on certain areas of the device from water vapor present as humidity in the surrounding air. Certain conventional methods of controlling the amount of heat applied to the display case doors includes applying full power (line voltage, typically) to the door heaters. The applied heat prevents condensation but disadvantageously often wastes energy as more heat is applied than is necessary to adequately prevent condensation. The excess energy consumed by the door heaters directly increases the cost of operating the refrigeration system. Such costs are further increased as excess energy in the form of heat is dissipated into the refrigerated space and must be removed by the refrigeration system.

Certain other conventional methods of controlling and varying the amount of heat applied to the display case doors utilize relatively expensive microprocessors and/or dedicated digital servo systems. However such implementations are relatively expensive to implement and so are not sufficiently suitable for certain applications.

Systems and methods for controlling anti-condensation heaters are disclosed herein which provide certain advantages over conventional approaches, although all the advantages discussed herein need not be present in a given embodiment. In certain embodiments, the systems and methods described herein provide a phase modulation of high-voltage AC power in response to a measured relative humidity (RH). In some of such embodiments, the phase-modulated AC power is provided in three different RH regions: a low RH region ranging from 0% RH to a first RH ($RH_1$), in which the phase-modulated AC power is constant at a non-zero power $P_{min}$; an intermediate RH region ranging from $RH_1$ to a second RH ($RH_2$), in which the phase-modulated AC power is linearly varying from $P_{min}$ to a maximum power level ($P_{max}$); and a high RH region ranging from $RH_2$ to a third RH ($RH_3$), in which the phase-modulated AC power is substantially constant at $P_{max}$.

Systems and methods described herein can achieve an energy-efficient control of power delivered to heating elements installed so as to prevent or reduce/eliminate water condensation on a control surface, such as a window (e.g., a glass window) of refrigerator display case (e.g., where the heaters are installed on, in, or near a control surface. The systems and methods may be used in a variety of refrigeration and freezer applications such as, but not limited to, display cases, walk-in refrigerators, and walk-in freezers, to control the temperature of a given control surface. For example, one or more embodiments of the presented system can be utilized with respect to walk-in refrigerators and freezers to prevent or reduce condensation from forming on air vents, personnel doors, drain lines, walls, and observation windows. Similarly, one or more embodiments of the present system can be utilized with respect to refrigerated display cases such as coffin cases, island cases, and tub cases to prevent condensation from forming on a wall or surface surrounding an opening and/or door of the display case. While the present system is applicable to each of the aforementioned refrigeration and freezer applications, the systems and methods will be described in association with a refrigerated display case having a door with a glass portion.

FIG. 1 shows a block diagram illustrating an example anti-condensation control system 100 according to one embodiment. The example anti-condensation control system includes a control section 110, a sensor section 120, and a heater section 150. The control section includes a phase control section 111 and a power supply section 112. The sensor section 120 includes a plurality of sensor modules 121-124 installed at a plurality of zones (although fewer or additional sensor modules can be used). The plurality of zones may represent a plurality of refrigerators/refrigerator cases that the control system 100 is monitoring and controlling. Similarly, the heater section 150 includes a plurality of heaters or heating elements 151-154 installed at the plurality of zones. A given zone can have one or more heater or heating elements.

The sensor modules 121-124 can include a relative humidity sensor configure to measure or sense relative humidity (RH) of an ambient air and/or a dew sensor configured to measure or sense water condensation. Optionally, a temperature sensor can be included as well, although certain embodiments advantageously provide heater control without a temperature sensor. The RH sensor and the dew sensor will be described in greater detail with respect to FIG. 4 below. Within a zone (which for the purpose of the following discussion is assumed to be zone 1), the sensor module 121 may be mounted on a surface, such as a door or other structure of the refrigerator/refrigerated case, such that the sensor module itself, and the air that it senses, is approximately the same as the humidity and/or temperature of the control surface. The sensor module 121 may be mounted to any portion of the door or structure of the refrigerator/refrigerated case wherein the structure to which the sensor module is mounted is indicative of the humidity/temperature of the control surface.

For example, if a glass pane of the door is deemed the control surface (i.e., the portion of the door to maintain free from condensation), the sensor module 121 may be mounted directly to the glass pane or, alternatively, to support structure either on the door, such as a door casing generally surrounding the glass pane, or to surrounding support structure, such as a door frame that operably supports the door. The sensor module 121, therefore, may be mounted on the glass pane, door casing, or door frame or within the glass pane, door casing, or door frame, or on top or below or side of an enclosure of the refrigerator, wherein the respective structure is indicative of the humidity and/or temperature as the control surface (e.g., generally at the same humidity and/or temperature as the control surface or at a predictable difference with respect to the control surface). By mounting the sensor module 121 in close proximity to the control surface, a sensor (e.g., a RH sensor and/or a dew sensor) of the sensor module 121 is able to accurately measure the relative humidity of air adjacent to and/or water condensation on the control surface.

While the sensor module 121 is described as being associated with a door of a refrigerator/refrigerated case, it should be understood that the sensor module 121 may alternatively be used with an open refrigerator/refrigerated case or a walk-in refrigerator/freezer. In such applications, the sensor module 121 can be mounted on any surface to be controlled (i.e., for which prevention of condensation is desired), such as walls, windows, doors, housing rails, or other support structure.

The heater 151 can be also installed in various locations/structures in the vicinity of the control surface where there is a sufficient heat conductivity between the structure that the heaters 151 is installed on and the control surface so that the heat generated by the heater can be effectively transferred to the control surface. The structure can be the glass pane, door casing, or door frame or within the glass pane, door casing, or door frame, or on top or below or side of an enclosure of the refrigerator. In one example embodiment, the heater is installed in the frame of a refrigerated display case door containing the control surface of a glass window.

Connections and operations of various sections of the anti-condensation system 100 are now described. The power supply section 112 of the control section 110 is connected to and configured to receive an alternating current (AC) power input 101 which can include a line voltage as measured respect to a neutral line 102. The line voltage can include a high AC voltage whose RMS value ranges between about 90 volts to 500 volts (although other voltages can be used as well). In some embodiments, the line voltage, hence the AC input power, is 110-120 Vac line. In other embodiments, the line voltage/AC input power can be 220-240 Vac line or 440-480 Vac line, or other line voltage. The power supply 112 receives the AC power input 101 and converts it into a regulated direct current (DC) voltage. The regulated DC voltage can be at a desired DC voltage. By way of example and not limitation, the DC voltage can in the range of between about 1 Vdc to 50 Vdc, such as about 3 Vdc, 5 Vdc, 10 Vdc, 12 Vdc, 15 Vdc, or 24 Vdc.

The sensor modules 121-124 can include sensing elements such as RH sensors and dew sensors and electronics that drive the elements and/or condition signals from the elements. The driving/conditioning electronics receive the regulated DC voltage from the power supply section 112 via a DC voltage line 105 and a DC common line 106. The sensor modules 121-124 provide sensor signals that indicate RH or water condensation to the sensor signal bus 130. In certain embodiments, the sensor signal bus 130 comprise of a plurality of sensor signal lines 131-134, each of which is dedicated to a sensor module associated with a zone, such as the sensor signal line 131 for the sensor module 121 associated with zone 1. The phase control section or circuit 111 is connected to and receives the DC voltage line 105 and the DC common line 106 to power its internal electronics. The phase control section 111 also receives sensor signal bus comprising a plurality of sensor signal lines 131-134 from the sensor modules 121-124.

The phase control section 111 is also connected to and receives the high-voltage AC power input 101. The phase control section 111 phase modulate the high-voltage AC power input and provide controlled power outputs 140 comprising individual power outputs 141-144 to the heaters 151-154 associated with different zones. In certain embodiments, the phase control section 111 can include a plurality of phase control circuits, each of which is connected to each of the sensor signal lines and provide a controlled power output to each of the heaters 151-154. The heaters associated with the different zones receive the power outputs 141-144 from the phase control section 111, where a power output (e.g., 141) provided to a heater (e.g., 151) associated with a zone (e.g., zone 1) is responsive to the sensor signal (e.g., 131) received from the sensor module (e.g., 121) associated with the same zone. In certain embodiments, the heater associated with the different zones or different doors of the same zone are connected in parallel and receive the same power output (e.g., phase-modulated AC voltage) from the phase control section based on a sensor signal received from one sensor module that monitors humidity and/or condensation in the different zones or the different doors. In some embodiments, the controlled power outputs 140 include phase-modulated AC power outputs. In some of such embodiments, the phase-modulated AC power outputs include phase-modulated AC voltages or current. In others, the phase-modulated AC power outputs include rectified DC versions of the phase-modulated AC voltages or current.

Figure 2:
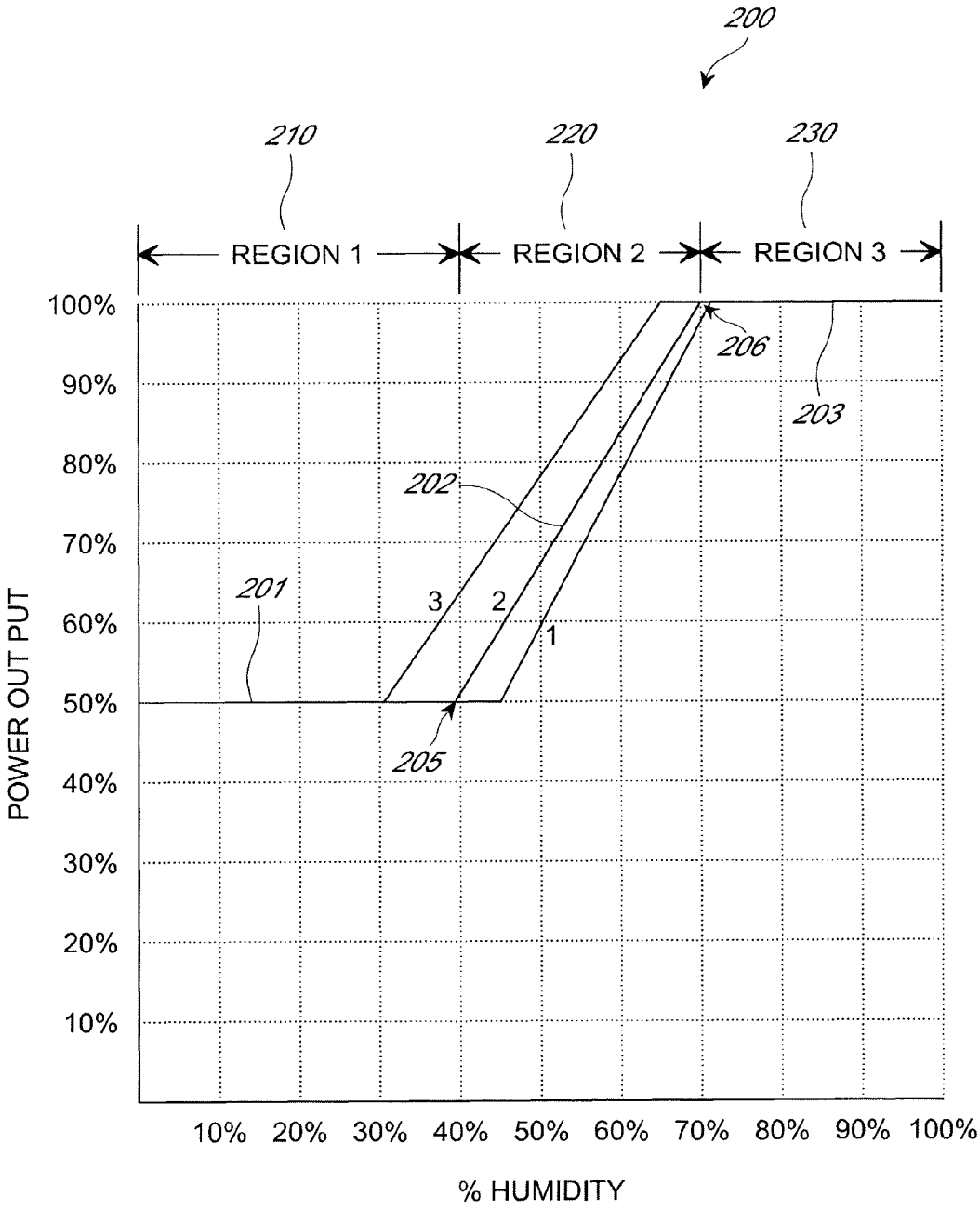
FIG. 2 shows a graph of power output v. relative humidity (RH) response function associated with a phase control circuit according to certain embodiments.

FIG. 2 shows a graph 200 of power output v. relative humidity (RH) response function associated with a phase control circuit according to certain embodiments. Three example traces—Trace 1, Trace 2, and Trace 3—are shown for the purpose of illustration. Focusing on Trace 2, there are three different regions 210, 220, 230: a first or low RH region ranging from 0% RH to a first RH ($RH_1$) 205, in which the phase-modulated AC power output is constant at a first non-zero power level ($P_{min}$) 201; a second or intermediate RH region ranging from $RH_1$ 205 to a second RH ($RH_2$) 206, in which the phase-modulated AC power output (indicated by element 202) varies from the first power level 201 ($P_{min}$) to a second or maximum power level ($P_{max}$) 203 in substantially a linear manner; and a high RH region ranging from $RH_2$ to a third RH ($RH_3$), in which the phase-modulated AC power is substantially constant at $P_{max}$ 203.

As the graph also illustrates, the power output v. RH response function can be made user-adjustable. An example hardware implementation that enables this user-adjustability will be described with respect to FIG. 5 below. As a way of illustration, assume that in one adjustment setting, the response function follows Trace 1. In another adjustment setting, the response function follows Trace 2. In yet another adjustment setting, the response function follows Trace 3. In the illustrated example, the adjustment changes the positions of RH1 and RH2 while leaving the slopes of the traces in the second RH region relatively unchanged. The user can make these changes to make the anti-condensation system better adapt to changing environment conditions. As a way of illustration, assume that the adjustment setting is set to a setting that causes the phase control circuit to provide a power output following Trace 2. If the environment condition changes to a less humid condition (e.g., due to a change of season), the user may change the adjustment setting to another setting that causes the phase control circuit to provide a power output of Trace 1 such that the second region (hence the ramping-up of output power) begins at a lower RH value. On the other hand, when the environment condition changes to a more humid condition, the user may change the adjustment setting to yet another setting that causes the phase control circuit to provide a power output of Trace 3 such that the second region (the ramping-up of output power) begins at a higher RH value.

While the traces shown in FIG. 2 share the same minimum power ($P_{min}$) and maximum power ($P_{min}$), this is for illustration purposes only and should be not taken to be so limiting. For example, in certain other embodiments, the adjustment can change the $P_{min}$ and/or $P_{min}$ value as well as changing the position of $RH_1$ and/or $RH_2$. In other embodiments, the adjustment can also change the slope of the trace in the second RH region. For example, in a dry environment condition, the $P_{min}$ and $P_{max}$ may range from 30% to 80% of a maximum power output of the phase control circuit (e.g., corresponding to 100% phase modulation) instead of ranging from 50% to 100% as shown in FIG. 2. While the traces of FIG. 2 show the power output varying substantially linearly in the second RH region, the power output may alternatively vary non-linearly, such as by exponentially, quadratically, logarithmically, step-wise, etc., with respect to the RH.

Figure 3:
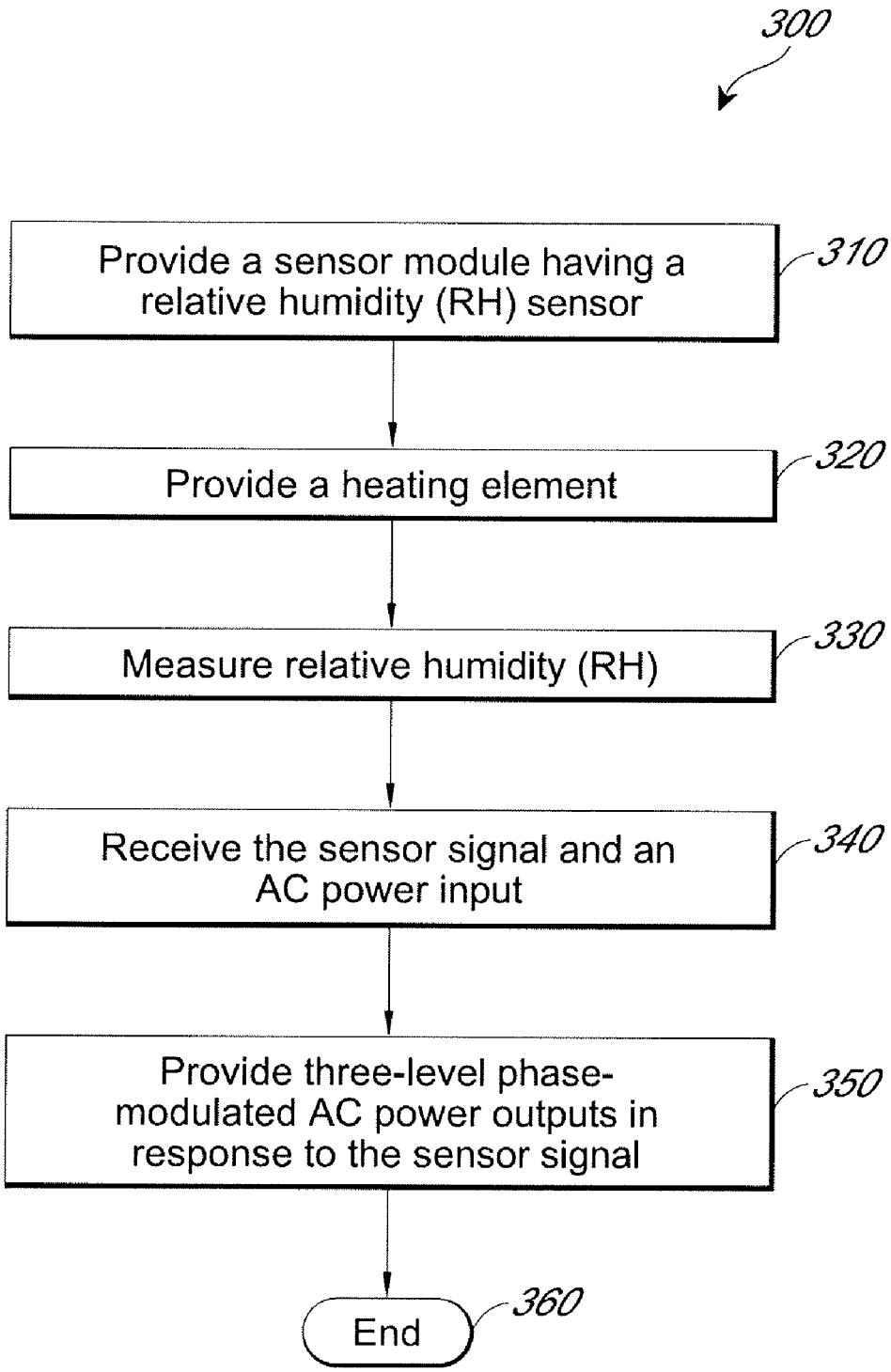
FIG. 3 shows a flowchart illustrating an example process for providing a phase-modulated AC power output to a heater.

FIG. 3 shows a flowchart illustrating an example process 300 for providing a phase-modulated AC power output to a heater. The process 300 begins at a state 310, where a sensor module is provided for a refrigerator device at a particular zone. The sensor module includes a relative humidity (RH) sensor configured to sense RH value of an ambient air on or near a control surface. In addition, the sensor module may also include a dew sensor to sense or detect water condensation on the control surface. As indicated above, the sensor module may be mounted to any portion of the door or structure of the refrigerator/refrigerated case so long as the structure to which the sensor module is mounted is indicative of the humidity/temperature of the control surface. In some embodiments that include a dew sensor, the dew sensor may be installed on the control surface itself.

The process 300 proceeds to a state 320, where a heater is installed on or near the control surface for the refrigerator device such that the heat generated by the heater in response to the phase-modulated AC power output can be efficiently transferred to the control surface. In certain embodiments, the heater can be in the form of a resistive or inductive heating element installed on a door frame containing a glass window or pane as the control surface. In other embodiments, the resistive or inductive heating element can be installed on the control surface itself, preferably around the outer edges of the surface. In yet other embodiments, the heater can be in the form of a transparent electrode coating such as an indium tin oxide coating deposited on parts of a glass pane.

The process 300 proceeds to a state 330, where the relative humidity (RH) of the ambient air on or near the control surface is measured using the RH sensor of the sensor module provide on or near the control surface. In some embodiments, water condensation on the control surface may also be measured in addition to or in lieu of the RH of the ambient air. The process 300 proceeds to a state 340, where a control module such as the element 110 and, more particularly, a phase control module such as the element 111 of the control module receive a sensor signal indicative of a sensed variable, e.g., RH or water condensation, from the sensor module. In certain embodiments, the phase control module may receive two independent sensor signals, one indicative of RH of the ambient air and the other indicative of water condensation. The sensor signal indicative of the RH is typically an analog signal representative of the RH of the ambient air. The sensor signal indicative of the water condensation can be an analog signal representative of a level or amount of water condensation or an on-or-off (ON/OFF) signal representative of an existence or an absence of water condensation. The phase control module also receives an AC power input. As indicated above, the AC power input can be a line voltage whose RMS value ranges between about 90 volts to 500 volts.

The process 300 proceeds to a state 350, where the phase control module modulates a phase of the AC power input at least partly in response to the received sensor signal(s). In particular, the phase control module modulates the AC power input in such a way or manner that the module provides a phase-modulated AC power output that can be in one of three output levels corresponding to three different output regions as discussed above with respect to FIG. 2. For example, in one embodiment, the phase control module provides a substantially constant minimum or second power output if the RH value is in a low RH range ranging from 0% to a first RH value ($RH_1$) (e.g., 40% RH) in a first or low RH region. If the RH value exceeds RH1, the module provides a power output that varies substantially linearly in response to a change in the RH value from $RH_1$ to a second RH value ($RH_2$) (e.g., 70% RH) in a second or intermediate RH region. If the RH value exceeds $RH_2$, the module provides a substantially constant maximum or second power output if the RH value exceeds $RH_2$ in a third or high RH region. The constant maximum or second power output may be provided from $RH_2$ to 100% RH or from $RH_2$ to a RH value less than 100% RH. In certain embodiments, the transition from the second or intermediate RH region to the third or high RH region may be triggered by a sensor signal from a dew sensor indicative of water condensation at the control surface. In some embodiments, the phase-control module may provide a constant power output above $RH_2$ but less than a maximum power until the module receives a sensor signal indicative of water condensation, at which point, the module provides a constant maximum power output. The process 300 ends at state 360.

For a setup involving multiple sensor modules installed in refrigerator devices in multiple zones, the phase control module may include multiple phase-phase circuits that independently modulate the AC power input in response to multiple sensor signals from the multiple sensor modules and provide multiple phase-modulated AC power outputs to heaters installed at the multiple zones. In certain embodiments, two or more refrigerator devices in two or more zones may share a sensor module and a phase control circuit if the refrigerator devices are in close proximity to each other and/or the operation condition of the refrigerator devices are substantially the same. For example, for a refrigerated display case may have two separate refrigerated spaces with two separate doors. But if the two refrigerated spaces generally operated under the same condition (e.g., the same temperature setting), one set of sensor module and phase control module may be used to provide the same phase-modulated AC power output to two separated heaters installed in the door frames, for example.

With respect to the following detailed descriptions of example circuits, it should be noted that the described topologies and components are provided to illustrate certain example embodiments, and other embodiments can utilize different topologies, components, and/or different numbers of components.

Phase Control Circuit

Figure 4:
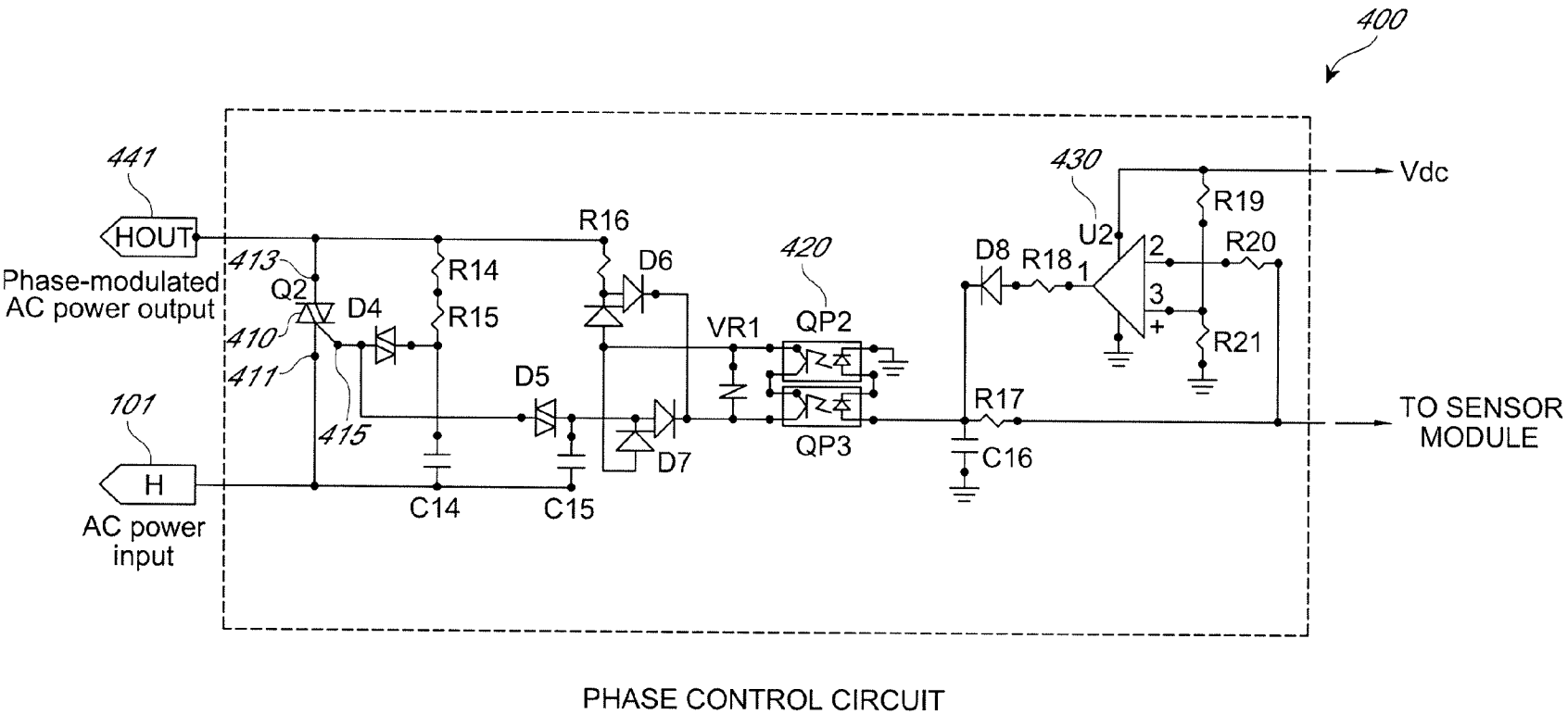
FIG. 4 shows a schematic circuit diagram illustrating an example phase control circuit according to one embodiment of the anti-condensation control system.

FIG. 4 shows a schematic circuit diagram illustrating an example phase control circuit 400 according to one embodiment of the anti-condensation control system. The example phase control circuit 400 includes an AC switch (Q2) 410 configured to receive a high-voltage AC power input (e.g., a line voltage) and a phase-control input 415 that triggers the AC switch to deliver a phase-modulated AC power output 441 to a heater (not shown). In certain embodiments, the AC switch (Q2) is a triode for alternating current (TRIAC) configured to phase modulate the high-voltage AC power input. In other embodiments, the AC switch can be one or more silicon-controlled rectifiers (SCRs). In some of such embodiments, two or more SCRs may be connected in an inverse parallel configuration for AC operation.

The example phase control circuit 400 also includes three output control circuits (some of which may share one or more common components) that provide control voltages to the phase-control input of the AC switch. The control voltages provided by the three level-control circuits can set the following three different phase-modulated AC power output levels as discussed above:

1) Output Level 1: a first constant and non-zero phase-modulated AC power output in a first or low RH region ranging from 0% RH to $RH_1$;

2) Output Level 2: a linearly-varying phase-modulated AC power output in a second or intermediate RH region ranging from $RH_1$ to $RH_2$; and 3) Output Level 3: a second constant and non-zero phase-modulated AC power output in a third or a high RH region ranging from $RH_2$ to $RH_3$.

The example embodiment of the phase control circuit 400 of FIG. 4 will be described with respect to these three output levels and their associated output control circuits.

Output Level 1:

A first output control circuit is configured to provide a first control voltage to the phase-control input to cause the AC switch provide the Output Level 1 described above (see, e.g., the element 201 of FIG. 2). In the illustrated example, the first output control circuit includes a TRIAC (Q2) 410, a diode (D4), resistors (R14, R15) for level setting and a capacitor (C14). The TRIAC (Q2) has an input terminal 411 and an output terminal 413 and a gate 415, the gate being the phase-control input of the AC switch. The input terminal 411 of Q2 410 is connected to the high-voltage AC power input 101, and the output terminal 413 of Q2 410 is connected to the phase-modulated AC power output 441.

In operation, a bias current whose magnitude is determined via values of R14 and R15 flows into and charges C14 to provide a bias voltage. The bias voltage at C14 triggers D14 and provides a first control voltage (e.g., the bias voltage at C14 minus a diode drop) at the input of the TRIAC (Q2) 410. The first control voltage turns on the AC switch 410 during a certain phase of the AC power input and provides the Output Level 1 to a heater (not shown). The Output Level 1 is not affected by a sensor signal from a RH sensor or dew sensor, and can be set by values of R14 and R15.

Output Level 2:

A second output control circuit provides a second control voltage to the phase-control input to cause the AC switch to provide the Output Level 2, namely, the linearly-varying phase-modulated AC power output (see, e.g., the element 202 of FIG. 2). In the illustrated example, the second output control circuit includes the TRIAC (Q2) 410, a diode (D5), a resistor (R16) for level setting and diodes (D6 and D7), opto couplers (OP2,3) 420, a resistor (R17) and a capacitor (C16). Also in the illustrate example, two optocouplers of OP2,3 420 are connected in series at both input and outside sides to form an OP2,3 combination.

In operation, a sensor signal indicative of RH of an ambient air on or near a control surface flows through R17 and charges C16 to provide a voltage at the input of the OP2,3 combination. R17 and C16 also form a low-pass filter that reduces or eliminates a noise (e.g., 60 Hz noise) picked up by a line carrying the sensor signal. The voltage at C16 provided to the input of the OP2,3 combination activates light emitting diodes (LEDs) in the input (control) side of the OP2,3. Transistors at the output (isolated) side of the OP2,3 combination receive the light generated by the LEDs and provide an output that is proportional to the sensor signal indicative of RH. The output of the OP2,3 combination and a bias current determined by R16 passes through D6 and D7 and charges C15 to provide a voltage. The voltage at C15 triggers D5 and provides a second control voltage at the gate 415 of Q2 410. The second control voltage turns on Q2 410 during a certain phase of the AC power input and provides the Output Level 2 to the heater. As discussed above, RH1 and RH2, the beginning and end points of the second RH region where the phase control circuit provides the Output Level 2, can be adjusted in the manner by the use of a trimming potentiometer. In certain embodiments, a trimming potentiometer can be included in the sensor module. Such a trimming potentiometer will be described with respect to FIG. 5 below.

Output Level 3:

A third output control circuit provides a third control voltage to the phase-control input to cause the AC switch to provide the Output Level 3, namely, the second constant and non-zero phase-modulated AC power output (see, e.g., the element 203 of FIG. 2). In the illustrated example, the third output control circuit includes, in addition to the components of the second output control circuit described above, a level-detection comparator (U2) 430, a diode (D8), and resistors (R18, 19, 20, 21). In the illustrated example, the level-detection comparator (U2) 430 is an op amp having a signal input (2), a reference input (3), and an output (1). The third output control circuit is configured to provide the third control voltage when RH is high (e.g., $RH>RH_2$) or when the water condensation is detected. In the illustrated example, U2 430 is provided to provide a sufficient voltage to the input of the OP2,3 combination to make the combination operate in s a saturation mode and thereby ensure that a third control voltage provided to the gate 415 of Q2 410 is high enough to cause the AC switch to provide a maximum (e.g., 100%) phase-modulated AC power to a heater when RH is high or when the water condensation is detected.

In operation, the signal input (2) of U2 430 receives a sensor signal indicative of RH, and the reference input (3) of U2 430 receives a reference voltage determined by a voltage divider formed by R19 and R21. When the RH exceeds a certain threshold RH value (e.g., $RH_2$ as shown in FIG. 2), the sensor signal indicative of the RH at the signal input (2) exceeds the reference voltage at the reference input (3) and the output (1) of U2 430 goes high. The high voltage at the output (1) drives the LEDs on the input side of the OP2,3 combination into saturation, and provides a low-resistance path at the transistors at the output side of the OP2,3 combination. A high current flows through the low-resistance path of the transistors and quickly charges C15 to a saturation voltage. The saturation voltage at C15 triggers D5 and provides a third control voltage (e.g., the voltage at C15 minus a diode drop) at the input of Q2 410. This arrangement ensures that the third control voltage provided at the gate 415 is high enough to cause Q2 410 to provide a maximum (e.g., 100%) phase-modulated AC power output to the heater.

While the illustrated example of the phase control circuit of FIG. 4 includes the level-detection comparator (U2) 430, in some embodiments, the level-detection comparator (U2) may not be necessary as an output amplifier provided at the sensor module may be sufficient to drive the LEDs of the OP2,3 combination into saturation. Therefore, in such embodiments, the second output control circuit described above can provide both second and third control voltages to the gate 415 of the TRIAC (Q2) 410.

Sensor Module

Figure 5:
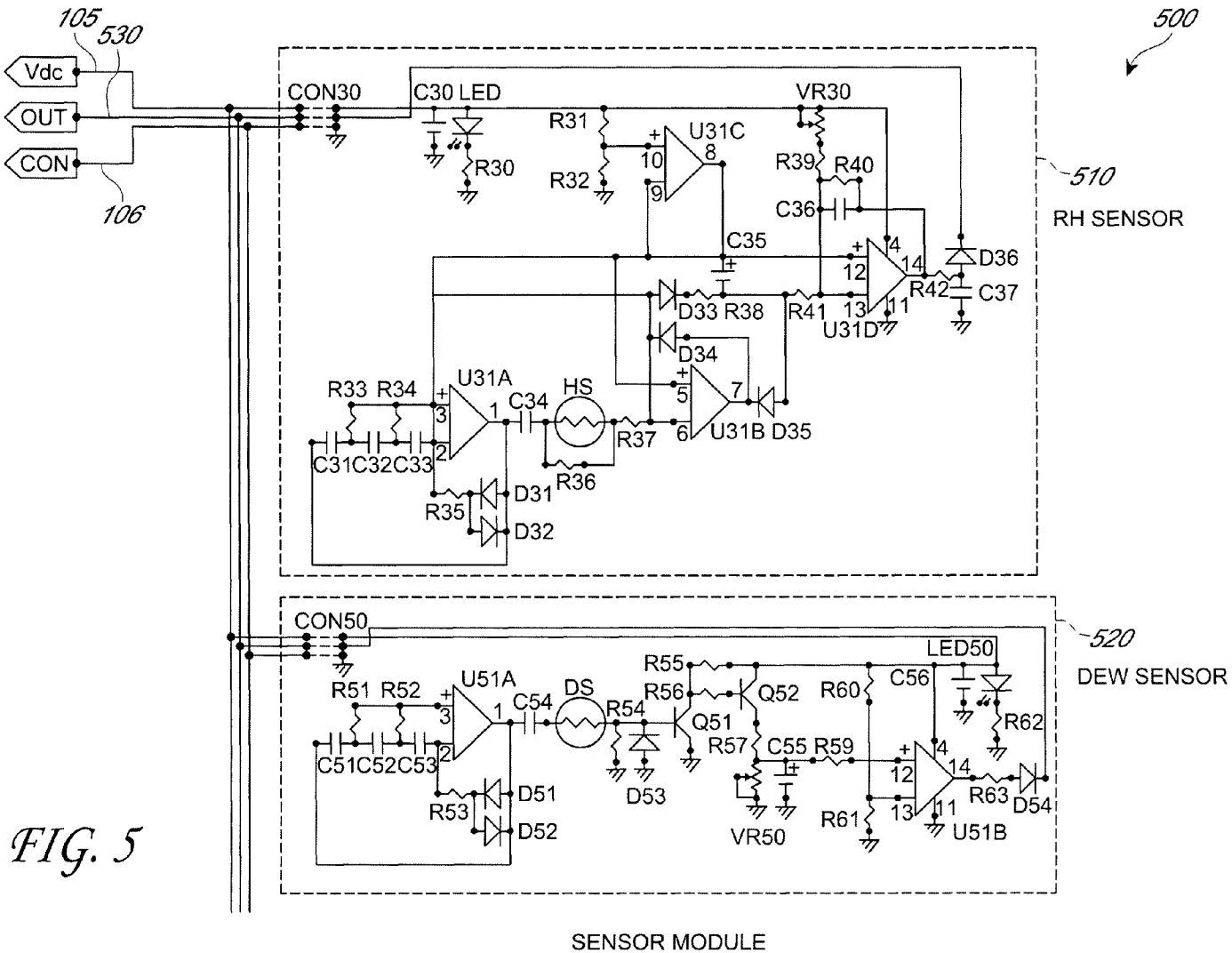
FIG. 5 shows a schematic circuit diagram illustrating an example sensor module according to one embodiment of the anti-condensation control system.

FIG. 5 shows a schematic circuit diagram illustrating an example sensor module 500 according to one embodiment of the anti-condensation control system. The example sensor module 500 includes two sensor modules: a RH sensor module 510 and a dew sensor (DS) module 520. In certain other embodiments, the sensor module includes only the RH sensor 510. The sensor module 500 also includes selection pins (COM 30 and COM 50) which provide the user to select one of the RH sensor module 510 and the DS module 520. In some embodiments, the sensor module provides one sensor output 530, e.g., from the RH sensor or the dew sensor. In other embodiments, the sensor module may provide multiple sensor outputs including the outputs from the RH module and the DS module and also any other types of sensors (e.g., a temperature sensor) that the sensor module may have.

RH Sensor

The example RH sensor module 510 is configured to provide a signal indicative of RH of an ambient air on or near a control surface. In the illustrated example, the RH sensor module 510 includes a RH sensor excitation section, a RH sensor section, and a RH signal conditioning section. The RH sensor excitation section includes a signal generator comprising an op amp (U31A), two resistors (R33, R34), and three capacitors (C31, C32, C33). The signal generator can generate an AC excitation signal, such as a sinusoidal wave, a square wave, a saw tooth wave, and the like. The amplitude of the AC excitation signal is stabilized or clipped by a combination of a resistor (R35) and two diodes (D31, D32) provided at the output of the signal generator.

The stabilized AC excitation signal, after passing through a DC block capacitor (C34), is applied to the RH sensor section comprising a humidity sensor (HS) and resistors (R36, R37). In response to the AC excitation signal, the RH sensor section provides an AC RH signal that is proportional to the sensed RH. The AC RH signal is then applied to the RH signal conditioning section comprising an op amp (U31B), diodes (D33, D34, D35), and a capacitor (C35). The RH signal conditioning section converts the AC RH signal into a sufficiently DC RH signal which is proportional to the sensed RH. The RH signal conditioning section also includes an amplifier section comprising an op amp (U31D), a trimming potentiometer (VR30), resistors (R39, R40), and a capacitor (C36). The amplifier section receives and amplifies the DC RH signal. The gain of the amplifier section can be adjusted by the trimming potentiometer (VR30). The trimmer potentiometer, by providing the gain adjustability, allows a user to change positions of RH1 and RH2, the beginning and end points of the second RH region. The amplified DC RH signal, after being current-limited and smoothed by a diode (D36), a resistor (R42), and capacitor (C37), is provided to the phase control circuit as a sensor signal indicative of RH.

Dew Sensor

In the illustrated example, the dew sensor (DS) module 520 is optionally provided. The dew sensor module 520 includes a DS excitation section, a dew sensor section, and a DS signal conditioning section. The DS excitation section includes a signal generator comprising an op amp (U51A), two resistors (R51, R52), and three capacitors (C51, C52, C53). The signal generator can generate an AC excitation signal, such as a sinusoidal wave, a square wave, a saw tooth wave, and the like. The amplitude of the AC excitation signal is stabilized by a resistor (R53) and two diodes (D51, D52) provided at the output of the signal generator. The stabilized AC excitation signal, after passing through a DC block capacitor (C54), is applied to the dew sensor (DS) section comprising a dew sensor (DS) and a resistor (R54). The dew sensor section provides an AC DS signal that is proportional to the sensed water condensation. The AC DS signal is then applied to the signal conditioning section. The signal conditioning section includes an amplifier section comprising transistors (Q51, Q52) resistors (R55, R56) that receive and amplify the AC DS signal. The amplified AC DS signal is divided by a voltage divider formed by a fixed resistor (R57) and a trimmer potentiometer (VR50) and converted into a DC DS signal by a capacitor (C55). The signal conditioning section further includes a level comparison section comprising a level-detection comparator (U51B) having a signal input (12), a reference input (13), and an output (14); and resistors (R60, R61). The reference input (13) receives a reference voltage from a voltage divider formed by R60 and R61, and the signal input (12) receives the DC DS signal after the signal passes through a resistor (R59). When the water condensation exceeds a threshold level, the DC DS signal provided at the signal input (12) exceeds the reference voltage provided at the reference input (13), the output (14) of the level-detection comparator (U51B) goes high. The high voltage output, after passing through a resistor (R63) and a diode (D54), can be optionally provided to the phase control circuit as a signal indicative of water condensation.

Thus, efficient methods and systems for reducing or preventing condensation are described herein. While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An anti-condensation control apparatus comprising:

a sensor circuit comprising a humidity sensor and configured to provide a sensor signal indicative of a relative humidity (RH) on or near a control surface; and a control circuit comprising a phase control circuit configured to:

receive the sensor signal and a high-voltage AC power input, and modulate a phase of the high-voltage AC power input at least partly in response to the sensor signal indicative of the RH on or near the control surface and without use of a temperature sensor, the phase control circuit configured to modulate the phase of the high-voltage AC power input in such a manner that a phase-modulated AC power output provided to a heater is:

a) substantially constant at a minimum power level ($P_{min}$) in a low RH region ranging from 0% RH to a first RH ($RH_1$), b) linearly varying from $P_{min}$ to a maximum power level ($P_{max}$) in an intermediate RH region ranging from $RH_1$ to a second RH ($RH_2$), and c) substantially constant at $P_{max}$ in a high RH region ranging from $RH_2$ to 100% RH, wherein the phase control circuit does not comprise a digital logic circuit.

2. The apparatus of claim 1, wherein the control surface comprises a window of a refrigerator door.

3. The apparatus of claim 2, wherein the heater is disposed in a frame of the refrigerator door.

4. The apparatus of claim 1, wherein:

the sensor circuit comprises a plurality of sensor modules installed at a plurality of zones comprising a plurality of control surfaces and configured to provide a plurality of sensor signals; and the control circuit comprises a plurality of phase-control modules and is configured to receive the plurality of sensor signals from the plurality of sensor modules, and provide a plurality of phase-modulated AC power outputs to a plurality of heaters installed in the vicinity of the plurality of control surfaces.

5. The apparatus of claim 1, wherein the humidity sensor comprises a resistance-type humidity sensor comprising two conductors installed in contact with the control surface, wherein a resistance across the two conductors changes as a function of RH.

6. The apparatus of claim 1, wherein the humidity sensor comprises a capacitance-type humidity sensor comprising two conductors installed in contact with the control surface, wherein a capacitance between the two conductors changes as a function of RH.

7. The apparatus of claim 1, wherein the sensor module further comprises a dew sensor configured to measure water condensation on or near the control surface.

8. The apparatus of claim 1, wherein the phase control circuit comprises a triode for alternating current (TRIAC) configured to phase module the high-voltage AC power.

9. The apparatus of claim 1, wherein the phase control circuit comprises one or more silicon-controlled rectifiers (SCRs) configured to phase module the high-voltage AC power.

10. The apparatus of claim 9, wherein the phase control circuit comprises at least two SCRs connected in an inverse parallel configuration.

11. The apparatus of claim 1, wherein the high-voltage AC power signal has an AC voltage whose RMS value is in a range between about 90 volts to about 500 volts.

12. The apparatus of claim 1, wherein the position of $RH_1$ and/or $RH_2$ is user-adjustable.

13. A method of preventing condensation anti condensation comprising:

receiving a relative humidity (RH) sensor signal from a sensor on or near a control surface;

receiving an AC power input;

modulating a phase of the AC power input at least partly in response to the sensor signal and without use of a temperature sensor, wherein the phase of the AC power input is modulated in such a manner that a phase-modulated AC power output provided to a heater is:

a) substantially constant at a first power level ($P_{1st}$) in a low RH region ranging from 0% RH to a first RH ($RH_1$), b) varying as a function of the sensor signal from $P_{1st}$ to a second power level ($P_{2nd}$) in an intermediate RH region ranging from $RH_1$ to a second RH ($RH_2$), and c) substantially constant at $P_{2nd}$ in a high RH region beginning at $RH_2$.

14. The method of claim 13, wherein the high RH region extends to 100% RH.

15. The method of claim 13, wherein the phase-modulated AC power output provided to the heater is substantially linearly varying from $P_{1st}$ to $P_{2nd}$ in the intermediate RH region ranging from $RH_1$ to $RH_2$.

16. The method of claim 13, wherein the act of modulating the phase is performed without a digital logic circuit.

17. The method of claim 13, wherein the position of $RH_1$ and/or $RH_2$ is user-adjustable.

18. The method of claim 13, wherein the control surface comprises a window of a refrigerator.

19. The method of claim 13, wherein the heater is disposed in a frame of a refrigerator door.

20. The method of claim 13, further comprising measuring water condensation on or near the control surface.

21. The method of claim 13, wherein the AC power input comprises an AC voltage whose RMS value is in a range between about 90 volts to about 500 volts.

22. The method of claim 13, further comprising:

receiving a condensation sensor signal from a condensation sensor configured to measure condensation formed on or near the control surface; and modulating the phase of the AC power input such that the phase-modulated AC power output provided to the heater is at a maximum power level ($P_{max}$) when the condensation sensor signal indicates that condensation is formed on or near the control surface, wherein the $P_{max}$ is greater than $P_{1st}$ and $P_{2nd}$.

23. An anti-condensation control apparatus, the apparatus comprising:

a sensor module configured to measure a relative humidity (RH) and/or a water condensation on or near a control surface, and provide a sensor signal indicative of the RH and/or the water condensation;

a control module configured to receive the sensor signal and an AC power input, and provide a phase-modulated AC power output to a heater at least partly in response to the sensor signal and without using a temperature sensor, the control module comprising:

an alternating current (AC) switch configured to receive a phase-control input that triggers the AC switch to deliver the phase-modulated AC power output to the heater during a specified phase of the AC power input, a first output control circuit configured to provide at least a portion of a first control voltage to the phase-control input to cause the AC switch to provide a first substantially constant phase-modulated AC power output to the heater in a low RH region, a second output control circuit configured to provide at least a portion of a second control voltage to the phase-control input to cause the AC switch to provide a substantially linearly varying phase-modulated AC power output to the heater in an intermediate RH region, and a third output control circuit configured to provide at least a portion of a third control voltage to the phase-control input to cause the AC switch to provide a second substantially constant phase-modulated AC power output to the heater in a high RH region.

24. The apparatus of claim 23, wherein the AC switch is a triode for alternating current (TRIAC) configured to phase modulate the high-voltage AC power input.

25. The apparatus of claim 23, wherein the sensor module is configured to measure the relative humidity (RH) and the water condensation on or near a control surface, and the control module is configured to provide a maximum phase-modulated AC power output to the heater when the sensor module indicates that condensation is formed on or near the control surface.

* * * * *

UNITED STATES PATENT AND TRADEMARK OFFICE

CERTIFICATE OF CORRECTION

PATENT NO. : 8,250,873 B2
APPLICATION NO. : 12/337981
DATED : August 28, 2012
INVENTOR(S) : Doo Eui Yoon et al.

It is certified that error appears in the above-identified patent and that said Letters Patent is hereby corrected as shown below:

In column 13 at lines 9-10, in Claim 13, after "preventing condensation" delete "anti condensation".

Signed and Sealed this
Twelfth Day of March, 2013

Teresa Stanek Rea
*Acting Director of the United States Patent and Trademark Office*